United States Patent [19]

Gabele

[11] Patent Number: 5,000,078

[45] Date of Patent: Mar. 19, 1991

[54] LIGHT METAL TRUNK PISTON FOR INTERNAL COMBUSTION ENGINES

[75] Inventor: Hugo Gabele, Stuttgart, Fed. Rep. of Germany

[73] Assignee: Mahle GmbH, Stuttgart, Fed. Rep. of Germany

[21] Appl. No.: 424,243

[22] PCT Filed: Apr. 18, 1987

[86] PCT No.: PCT/EP88/00321

§ 371 Date: Oct. 2, 1989

§ 102(e) Date: Oct. 2, 1989

[87] PCT Pub. No.: WO88/08078

PCT Pub. Date: Oct. 20, 1988

[30] Foreign Application Priority Data

Apr. 18, 1987 [DE] Fed. Rep. of Germany ..... 37212242

[51] Int. Cl.[5] ..... F02F 3/00

[52] U.S. Cl. ..... 92/228; 123/193 P

[58] Field of Search ..... 123/193 P; 92/225, 227, 92/228, 229, 230

[56] References Cited

U.S. PATENT DOCUMENTS

| | | | |
|---|---|---|---|
| 1,825,750 | 10/1931 | McCoy | 92/230 |
| 2,086,677 | 7/1937 | Nelson | 92/228 |
| 2,110,346 | 3/1938 | Teetor | 92/228 |
| 2,551,488 | 5/1951 | Deming . | |
| 3,908,521 | 9/1975 | Cockcroft | 92/228 |
| 4,074,617 | 2/1978 | Cockcroft | 92/228 |
| 4,669,366 | 6/1987 | Ellermann et al. | 92/229 |
| 4,890,543 | 1/1990 | Kudou et al. | 92/225 |

FOREIGN PATENT DOCUMENTS 812385 5/1937 France .

*Primary Examiner*—Andrew M. Dolinar
*Assistant Examiner*—M. Macy
*Attorney, Agent, or Firm*—James C. Wray

[57] ABSTRACT

The external profile of a piston rod employed in the engines of passenger cars ensures smoother piston travel on start-up and during partial loading. In these operating ranges, piston ring parts may impact on the sliding surface of the cylinder on the counter-pressure side and give rise, amongst others things, to undesirable noise. To obviate such impacts, the piston rod tapers at the end facing the crankshaft space on the counter-pressure side, and has a transversal slit (3) at its junction with the piston head and an adjustment strip (4) in the vicinity of the said slit. An additional adjustable strip (5) may also be provided in the lower part of the rod, on the pressure side. As a result of the position of the adjustment strips, the special design of the piston and the special shape of the rod casing, the piston head aligns itself at a slight angle to the counter-pressure side, with increasing play between the piston head and the sliding surface of the cylinder in the said operating ranges.

16 Claims, 3 Drawing Sheets

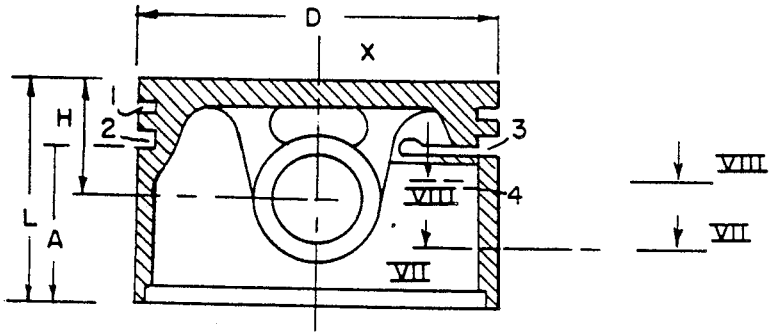
FIG. 1
FIG. 3
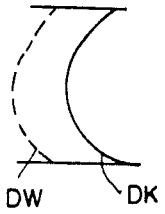
FIG. 2
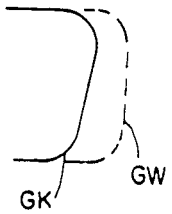
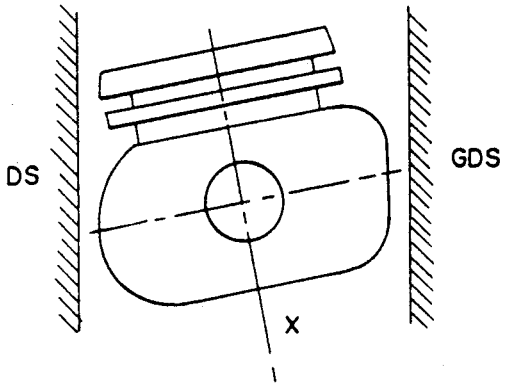
FIG. 4
FIG. 5
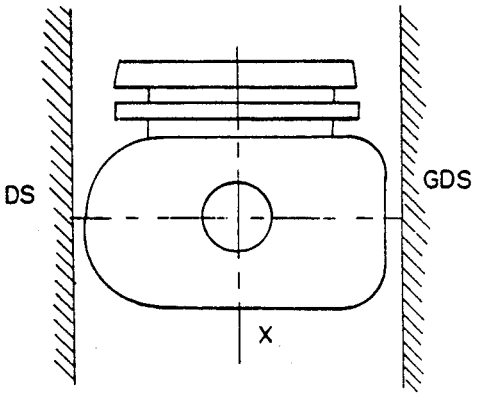

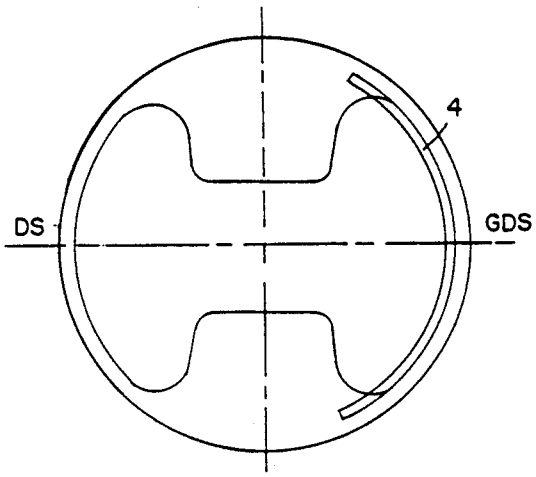
FIG. 6
FIG. 7
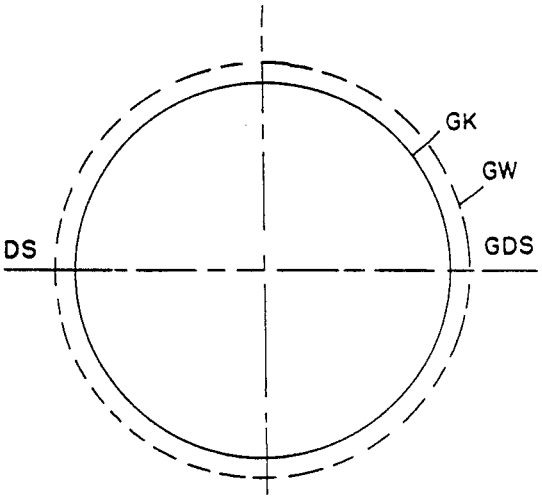
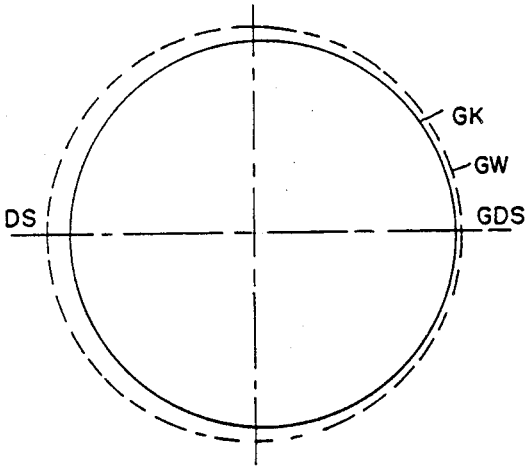
FIG. 8
FIG. 12
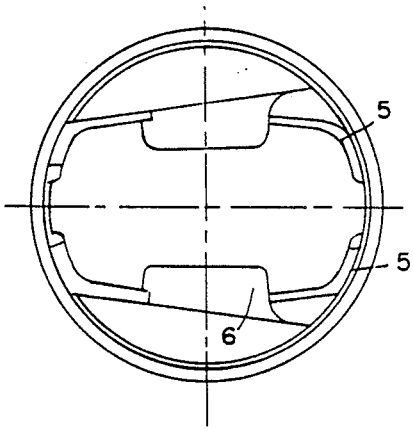

FIG. 9
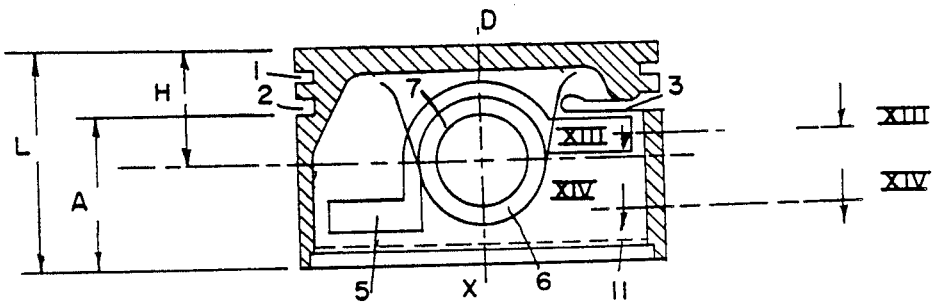
FIG. 11
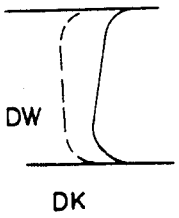
FIG. 10
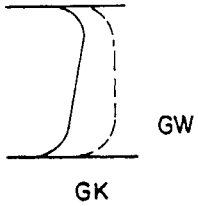
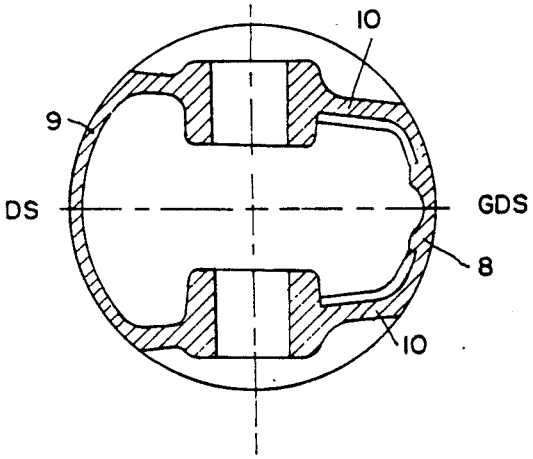
FIG. 13
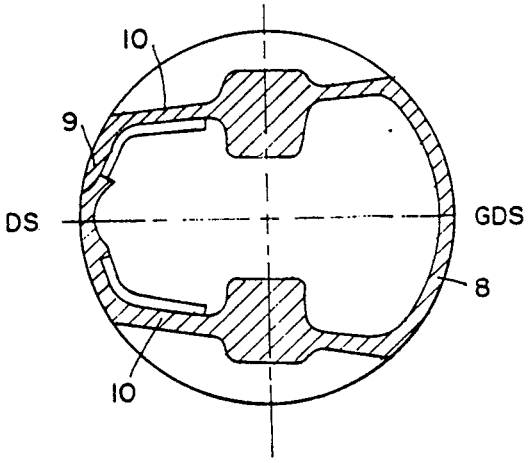
FIG. 14

LIGHT METAL TRUNK PISTON FOR INTERNAL COMBUSTION ENGINES

BACKGROUND OF THE INVENTION

1. Field of the Invention

The invention relates to a light metal trunk piston for internal combustion engines.

2. Prior Art

Such pistons are known from GB-PS No. 12 56 242. In each of the prior art pistons, a control strip is inserted at the top end of the skirt and is of a width which varies over its periphery. The width varies in that the radial thickness of the control strip is at its smallest on the pressure side of the piston and at its greatest on the counter-pressure side. Consequently, on the counter-pressure side of the skirt there is a smaller radial expansion of the upper part of the skirt than there is on the pressure side. Due to the lesser expansion of the upper portion of the skirt on the counter-pressure side under temperature, it is possible to achieve a very close running tolerance of the skirt when it is cold. Linked with the closer running tolerance is a reduction in the running noise when cold, which is greatly influenced by the top land on the counter-pressure side striking the cylinder liner when the engine is cold.

SUMMARY OF THE INVENTION

It is on this premise that the invention is based on the problem, in the case of a piston of the type mentioned at the outset, of still further reducing the noise caused by the piston head striking the cylinder liner on the counter-pressure side when the piston is cold.

In the case of a piston of the type mentioned at the outset, this problem is resolved by an embodiment of piston skirt according to the characterising features described hereinafter.

Expedient further developments of the invention are the object of the sub-Claims. Particular significance attaches to the teaching according to claim 2, and this will be dealt with in greater detail hereinafter.

As a result of the design and outer form of the piston skirt, when it is cold, the piston assumes a position in the engine cylinder in which the piston head has its top end on the pressure side so inclined in relation to the cylinder liner that in the region of the top land the clearance in respect of the cylinder liner is greater on the counter-pressure side than it is on the pressure side. Consequently, when the engine has just been started and when it is running on partial load, when the piston is still at a relatively low temperature, noise build-up due to the ring portion striking the counter-pressure side can be avoided.

The indicated inclination of the piston head when the piston is cold in the engine cylinder is achieved in that the outer surface on the counter-pressure side is inclined from the top downwardly vis-a-vis the longitudinal axis of the piston, the radial distance in respect of the piston axis diminishing, in fact, towards the bottom end of the piston skirt. Bearing of the piston on the thus inclined outer surface on the counter-pressure side is further favored by reason of the inclination of the outer surface of the piston skirt which according to claim 2 is orientated in the opposite direction on the pressure side. This statement again relates to the situation when cold.

The pattern of the generatrix which is substantially rectilinear over a wide portion on the counter-pressure side is advantageous to the attainment of the inclined attitude of the piston which is desired for partial loading of the engine.

As the piston skirt becomes increasingly heated, the control strip inserted on the counter-pressure side in the upper end portion of the skirt impedes the expansion of the light metal under heat in this area of the skirt, while the lower portion of the skirt on the counter-pressure side can expand considerably more since it is not impeded by a control strip. Thus, the generatrix on the counter-pressure side of the skirt when the engine is under full load assumes a pattern which is orientated substantially parallel with the longitudinal axis of the piston head. Therefore, the piston head then also runs centrally in the cylinder bore.

The other control strip which is provided on the pressure side, in the lower portion of the skirt, exerts an influence in the same direction. In fact, it ensures that by providing a greater radial distance between the outer surface of the skirt and the longitudinal axis of the pinion in the region of the control strips, compared with the portion of the skirt above it on the counter-pressure side, bearing of the piston against the cylinder liner is additionally enhanced in the lower portion of the skirt.

A conventional measure to reduce piston noise when an engine is running resides in offsetting the boss bore of the piston. Generally, this offset is to the pressure side. Thus, when combustion starts, there is a tilting moment at the top dead centre position of the compression stroke which forces the piston head towards the counter-pressure side. At the same time, the lower portion of the piston skirt on the counter-pressure side is forced radially outwardly. Therefore, in the aforesaid areas of the skirt (the top of the counter-pressure side and the bottom of the pressure side) bearing forces are created which ought to be accommodated with the least possible elastic deformation. For close guidance of the skirt which, in the cold state, is inclined towards the longitudinal axis of the piston head, it is therefore advantageous for the bottom portion of the skirt, on the pressure side, to be of more rigid construction than on the counter-pressure side. In the upper part of the skirt, on the other hand, the counter-pressure side of the skirt should in turn be relatively rigid to make sure that, in the cold state, the greater radial distance of the outer surface from the longitudinal axis of the piston head in relation to the bottom portion is assured and not restricted again by an excessively high elastic deformability in this area. The differences in rigidity can inter alia be varied by the extent of the unsupported arc length of the skirt on the pressure and counter-pressure sides.

When the engine is running hot, there are generally no noise problems. This is due to the fact that when the piston is hot, the running clearance is so reduced compared with the cold clearance which was initially present that tilting of the piston which can result in the top land striking the cylinder liner, is no longer of practical importance. The lessening of the clearance when the engine is hot can lead to a theoretical overlap in respect of the cylinder liner surface.

Although JP Abstract No. 57-81144 discloses a piston for two-stroke engines in which, in order to reduce noise, the piston skirt has a profile which to a certain extent produces an oblique attitude of the piston, it does lack the measures according to the invention which aim at a rectilinear orientation of the piston as the engine load increases. According to the invention, these measures consist in particular in the provision of a transverse slot between the piston head and the piston skirt on the counter-pressure side and in the provision of a control strip in the upper portion of the piston skirt, solely on the counter-pressure side and possibly also the provision of a further control strip in the bottom portion of the pressure side half of the piston skirt.

Furthermore, asymmetrical types of skirt are in themselves likewise known from DE No. 35 27 032 A1, but this, too, lacks any reference to the specific design of the skirt according to the invention, which is intended to reduce impact noises of the piston head.

Other advantages and features of the invention will be apparent from the disclosure, which includes the above and ongoing specification with the claims and the drawings.

BRIEF DESCRIPTION OF THE DRAWINGS

An example of embodiment is shown in the accompanying drawings, in which:

FIG. 1 shows a first embodiment of piston in longitudinal section;

FIG. 2 shows the pattern of the axial generatrix of the piston skirt when cold and hot, according to FIG. 1, on the counter-pressure side;

FIG. 3 shows the pattern of the axial generatrix of the piston skirt when cold and hot, according to FIG. 1, on the pressure side;

FIG. 4 shows the oblique orientation of the cold piston skirt according to FIG. 1 inside the engine cylinder;

FIG. 5 shows the orientation of the hot piston skirt according to the FIG. 1 while the engine is running and inside the engine cylinder;

FIG. 6 is a view of the piston according to FIG. 1, from below;

FIG. 7 shows the pattern of the polar generatrix (cold and hot state) of the piston skirt in the plane VII;

FIG. 8 shows the pattern of the polar generatrix (cold and hot state) of the piston skirt in the plane VIII;

FIG. 9 shows a second embodiment of piston in longitudinal section;

FIG. 10 shows the pattern of the axial generatrix of the cold and hot piston skirt according to FIG. 9, on the counter-pressure side;

FIG. 11 shows the pattern of the axial generatrix of the cold and hot piston skirt according to FIG. 9, on the pressure side;

FIG. 12 is a view of the piston according to FIG. 9, from below;

FIG. 13 shows a section through the piston, taken on the plane XIII, and

FIG. 14 shows a section through the piston, taken on the plane XIV.

DETAILED DESCRIPTION OF THE DRAWINGS

The piston consists of an aluminium-silicon alloy. In its head part there are annular grooves 1 for compression rings and underneath an annular groove 2 for an oil control ring.

The letters shown in the drawing have the following significance:

D=maximum diameter of the piston
L=maximum length of the piston
H=compression height
A=mean skirt height below the bottom ring groove at about the same skirt height of at least 90° on the pressure and counter-pressure sides respectively
DS=pressure side of the piston
GDS=counter-pressure side of the piston
X=longitudinal axis of the piston determined by the piston head.
DK=skirt generatrix when cold
DW=skirt generatrix when hot.

The skirt of the piston is separated from the piston head on the counter-pressure side by a transverse slot 3. The transverse slot 3 extends in a peripheral direction over a total of 90° and in fact symmetrically on both sides of the plane passing through the longitudinal axis X in a pressure/counter-pressure direction.

Where the embodiment of piston according to FIG. 1 is concerned, it is only on the counter-pressure side, on the inside of the skirt and in its upper portion that a steel control strip 4 is inserted. As the piston skirt becomes increasingly heated, the control strip impedes expansion of the light metal under heat in this upper area of the skirt, while the lower portion of the skirt on the counter-pressure side can expand more, unimpeded by the control strip. This regulates the axial generatrix of the piston of the skirt such that the generatrix runs parallel with the longitudinal axis "x" when under full load. The regulating effect emanating from this control strip as the piston heats up amounts to a maximum of about 50 mm for piston diameters of between 70 and 100 mm.

FIG. 4 shows the piston according to FIG. 1 in the position which it assumes in the engine cylinder during the compression stroke when the engine is cold. Due to the oblique position of the connecting rod during this stroke, the skirt of the piston bears on the counter-pressure side during the downwards movement. In the region of the piston skirt on the counter-pressure side, the orientation is created by the axial generatrix which extends there over a fairly large area in a straight line. The rectilinear pattern of the generatrix extends from the bottom end of the skirt up to about 15% before the top end of the skirt. On the pressure side, the axial generatrix is, on the other hand, substantially convex in pattern. When the piston tips back from the counter-pressure side to the pressure side in the top dead centre position of the piston, the piston is able to roll softly over the convex skirt shape on the pressure side so achieving an additional improvement in piston skirt running noise.

However, the major reduction in noise is due to the fact that on the counter-pressure side, the piston head is spaced apart from the cylinder liner surface sufficiently by reason of the fact that the skirt jacket is inclined and therefore, under partial loading or while the engine is still not up to running temperature, the piston head cannot strike the cylinder wall.

The angle of inclination of the axial generatrix of the skirt on the counter-pressure side is so chosen that under full load, the regulating effect of the control strip 4 ensures that the generatrix runs parallel with the longitudinal axis X. The control strip 4 is mounted directly at the top end of the skirt and in the example illustrated extends over a height amounting to 25% of the total skirt length. The diameter of the top land of the piston head is smaller than the maximum diameter of the piston skirt. FIG. 4 shows very clearly how the piston head is brought by the skirt when the piston is cold into such an oblique position that the clearance between the ring part and the cylinder liner is markedly greater on the counter-pressure side of the piston than it is on the diametrically opposite pressure side of the piston. This avoids the ring part knocking and causing the piston noises.

FIGS. 7 and 8 show to a greatly oversized scale the peripheral generatrix of the piston skirt in two superposed planes.

Where the piston according to FIG. 9 is concerned, in addition to the control strip 4 disposed on the counter-pressure side in the upper part of the skirt, there is also in the bottom part of the skirt and on the pressure side a further control strip 5. The control strips 4 and 5 extend respectively from one of the two bosses 6 around the periphery to points preceding the piston tilting plane which extends at a right-angle to the gudgeon pin axis, i.e. the control strips are peripherally separated from each other in the region of the piston tilting plane. Particularly for reasons of simplified fitment of the control strips when the pistons are cast, one control strip 4 and 5 will be respectively connected to a common control strip 7 which is connected in the region of the piston boss 6.

Due to the control strip 5 in the bottom part of the skirt on the pressure side, the piston, while it is cold in this bottom part of the skirt, allows a radial clearance which is sufficiently close on the counter-pressure side. A bearing on the outer shell of the skirt on the counter-pressure side, is inclined inwardly from top to bottom. Thus, as it tilts over to the counter-pressure side, the piston comes to bear sooner through the bottom part of the skirt on the pressure side, so reducing the tilting angle. In a region of the control strip (5), when the piston is in the cold state, the distance between the skirt generatrices (DK) on the pressure side and the longitudinal axis of the piston, is at the greatest.

Thus, over its axial height, the piston skirt is altered in its rigidity in that the bearing surfaces of the skirt are peripherally of unequal width and are in each case braced radially inwardly at the peripheral end. The differing elasticity in an axial direction is thereby so distributed that on the counter-pressure side, in the upper region in which the control strip 4 is disposed, the piston skirt is more rigidly guided than it is in that portion of the skirt which is underneath. On the pressure side, on the other hand, the bottom portion of the skirt is more rigidly constructed than the bottom part of the skirt which is opposite, on the counter-pressure side. The walls 10 which connect the bearing skirt surfaces 8, 9 in the direction of the piston axis are, in their course, governed by the form of the bearing surfaces 8, 9 which vary over the height of the skirt. The bosses 6 can project radially beyond these walls 10. At the bottom end of the skirt, for production reasons, a narrow encircling annular shoulder 11 can be provided. Such an annular shoulder makes it possible for the piston to be rolled along as it is transported through the individual production stations.

While the invention has been described with reference to specific embodiments, modifications and variations of the invention may be constructed without departing from the scope of the invention, which is described in the following claims.

I claim:

1. Light metal trunk piston for internal combustion engines with a piston head containing the piston ring grooves and, immediately below the lowest ring groove, a piston skirt having the following properties:

(a) the piston head has a longitudinal axis X which is the axis for its axial generatrices, (b) the piston skirt on a counter-pressure side is separated from the piston head by a transverse slot, (c) inside the piston skirt, at a top end thereof, there is at least one control strip, the material of which has a lower heat expansion coefficient than the light metal of the piston, characterized by the features:

(d) the control strip disposed at an upper end of the piston skirt is confined to that half of the skirt which is towards the counter-pressure side, (e) when the piston is in a cold state, the generatrix on the counter-pressure side extends in such a way that at least in a middle third of the skirt height its distance from the longitudinal axis X diminishes steadily towards an end of the skirt and is substantially rectilinear in this height range, (f) wherein further on that half of the skirt which is on the pressure side and at a bottom end thereof, there is a second control strip, the material of which has a lower heat expansion coefficient than the light metal of the piston, (g) in a region of the second control strip, when the piston is in the cold state, a distance between the skirt generatrices on the pressure side and the longitudinal axis of the piston is at the greatest.

2. A light metal trunk piston for internal combustion engines, comprising:

(a) a piston head containing piston ring grooves, and having a longitudinal axis for its axial generatrices and further having pressure and counter-pressure sides;

(b) a piston skirt extending immediately below the piston ring grooves;

(c) a transverse slot formed in the piston on the counter-pressure side thereof separating the piston skirt from the piston head;

(d) at least one control strip, the material of which has a lower heat expansion coefficient than that of the light metal of the piston, located in a top end of that half of the skirt at the counter-pressure side;

(e) a generatrix of the piston on the pressure side being convex when the piston is in a cold state;

(f) the generatrix of the piston on the counter-pressure side extending axially in such a way that at least in the middle third of the skirt axial length its distance from the longitudinal axis diminishes gradually towards an end of the skirt and is substantially rectilinear over this axial skirt length when the piston is in a cold state.

3. A light metal trunk piston according to claim 2, characterized in that in its upper portion, on the counter-pressure side, the piston skirt has a smaller periphery bearing on a wall of an engine cylinder than on a pressure side wall in a lower portion of the skirt, wherein the skirt portions which bear on the cylinder wall are in each case, at peripheral ends, braced in the direction of the piston axis over the height of the skirt, and skirt surfaces which run on the cylinder wall are symmetrical with a tilting plane of the piston (the plane extending at right-angles to a gudgeon pin axis and containing the longitudinal axis of the piston), there possibly being at a bottom end of the skirt, a closure means, with a narrow annular shoulder extending over an entire periphery.

4. A light metal trunk piston according to claim 1, characterized in that the control strips disposed on the pressure and counter-pressure sides are connected to one another.

5. A light metal trunk piston according to claim 4, characterized in that there are altogether two control strips, each of which passes through one of two hub regions of the piston, ending in each case before a piston tilting plane.

6. A light metal trunk piston according to claim 2, characterized in that when the piston is in the cold state a generatrix on the counter-pressure side extends in such a way that in a region between a bottom end and a top quarter of the piston skirt, its distance from the longitudinal axis X reduces steadily towards the skirt end.

7. A light metal trunk piston according to claim 6, characterized in that when the piston is in the cold state, the generatrix on the counter-pressure side extends in such a way that in a region between a bottom end and a top 10% of the height of the piston skirt its distance from the longitudinal axis X reduces steadily towards the skirt end.

8. A light metal trunk piston according to claim 2, characterized in that a pattern of the generatrix on the counter-pressure side extends over a periphery of at least 30 degrees.

9. A light metal trunk piston according to claim 2, characterized by the following dimensions:

$L=(0.45-0.65)\times D$ $A=(0.25-0.4)\times D$ $H=(0.3-0.4)\times D$ in which

D=maximum diameter of the piston

L=maximum length of the piston

H=compression height

A=mean skirt height below a bottom ring groove in a portion of a periphery which is of about the same skirt height of at least 60 degrees both on a'pressure side and also on the counter-pressure side.

10. The light metal trunk piston according to claim 2, characterized in that the control strips disposed on the pressure and counter-pressure sides are connected to one another.

11. The light metal trunk piston according to claim 10, characterized in that there are altogether two control strips, each of which pass through one of two hub regions of the piston, ending in each case before a piston tilting plane.

12. The light metal trunk piston according to claim 1, characterized in that in its upper portion, on the counter-pressure side, the piston skirt has a smaller periphery bearing on a wall of an engine cylinder than on the pressure side wall in a lower portion of the skirt, wherein the skirt portions which bear on the cylinder wall are in each case, at peripheral ends, braced in the direction of a piston axis over a height of the skirt, and skirt surfaces which run on the cylinder wall are symmetrical with a tilting plane of the piston (the tilting plane extending at right-angles to a gudgeon pin axis and containing the longitudinal axis of the piston), there possibly being at a bottom end of the skirt, a closure means, with a narrow annular shoulder extending over an entire periphery.

13. The light metal trunk piston according to claim 1, characterized in that when the piston is in the cold state, the generatrix on the counter-pressure side extends in such a way that in a region between a bottom end and a top quarter of the piston skirt, its distance from the longitudinal axis X reduces steadily toward a skirt end.

14. The light metal trunk piston according to claim 13, characterized in that when the piston is in the cold state, the generatrix on the counter-pressure side extends in such a way that in a region between the bottom end and a top 10% of the height of the piston skirt is distanced from the longitudinal axis X reduces steadily towards the skirt end.

15. The light metal trunk piston according to claim 1, characterized by the following dimensions:

$L=(0.45-0.65)\times D$ $A=(0.25-0.4)\times D$ $H=(0.3-0.4)\times D$ in which

D=maximum diameter of the piston

L=maximum length of the piston

H=compression height

A=mean skirt average below a bottom ring groove in a portion of a periphery which is about the same skirt height of at least 60 degrees both on the pressure side and also on the counter-pressure side.

16. A light metal trunk piston according to claim 2, wherein two control strips are provided at the counter-pressure side.

* * * * *